US006688263B1

(12) United States Patent
Yamamoto et al.

(10) Patent No.: US 6,688,263 B1
(45) Date of Patent: Feb. 10, 2004

(54) SYSTEM FOR CONTROLLING THE TEMPERATURE OF A CYLINDER WALL IN AN ENGINE

(75) Inventors: Kazuhiro Yamamoto, Saitama (JP); Masao Komine, Saitama (JP); Mitsuru Sugimoto, Saitama (JP); Masakatsu Miyao, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 65 days.

(21) Appl. No.: 09/721,701

(22) Filed: Nov. 27, 2000

(30) Foreign Application Priority Data

Nov. 25, 1999 (JP) ..... 11-333595
Nov. 26, 1999 (JP) ..... 11-335741
Nov. 26, 1999 (JP) ..... 11-335742

(51) Int. Cl.[7] ..... F01P 3/18
(52) U.S. Cl. ..... 123/41.57
(58) Field of Search ..... 123/41.57, 41.55, 123/41.79, 41.72

(56) References Cited

U.S. PATENT DOCUMENTS 2,376,160 A * 5/1945 Marburg ..... 123/41.57
2,497,781 A * 2/1950 Logashkin ..... 123/41.57
4,108,118 A * 8/1978 George ..... 123/41.57
4,825,816 A * 5/1989 Yamada et al. ..... 123/41.57
4,873,944 A * 10/1989 Yamada ..... 123/41.57
5,337,704 A * 8/1994 Roth ..... 123/41.1
5,970,927 A * 10/1999 Suzuki ..... 123/41.05

FOREIGN PATENT DOCUMENTS

JP 63088215 4/1988
JP 1-227850 9/1989
JP 3-67052 3/1991

* cited by examiner

*Primary Examiner*—Henry G. Yuen
*Assistant Examiner*—Jason Benton
(74) *Attorney, Agent, or Firm*—Arent Fox Kintner Plotkin & Kahn

(57) ABSTRACT

A gas jacket is provided in a lower portion of a cylinder block, so that an exhaust gas in an exhaust gas passage is supplied to the gas jacket through an exhaust gas supply passage having an exhaust gas supply valve. Fresh air in an intake passage is supplied to an intake passage through a fresh-air supply passage having a fresh-air supply valve. The temperature of a lower cylinder wall is controlled in a feedback manner to a target temperature for the lower cylinder wall. The target temperature for the lower cylinder wall is set at a sufficiently high temperature in a range in which an oil film of lubricating oil, extending from an intermediate portion of the cylinder wall to a bottom dead center of a piston, can be ensured. Therefore, the viscosity of the lubricating oil can be decreased to minimize the friction loss at slide portions of the cylinder wall and the piston, thereby providing an increase in engine output, a reduction in amount of fuel consumed and a reduction in lubricating oil consumed.

7 Claims, 13 Drawing Sheets

SYSTEM FOR CONTROLLING THE TEMPERATURE OF A CYLINDER WALL IN AN ENGINE

BACKGROUND OF THE INVENTION

1. Field of the Invention

The present invention relates to a system for controlling the temperature of a cylinder wall in an engine to heat and cool the cylinder wall of the engine, or to provide an appropriate temperature profile to the cylinder wall of the engine in order to reduce the frictional resistance of a piston.

2. Description of the Related Art

A cooling circuit or a water jacket has been proposed in recent years for use in an engine, which is designed so that its ability to cool a portion around a combustion chamber and an upper portion of a cylinder liner is increased to inhibit the knocking. Additionally, over-cooling of the lower portion of the cylinder liner is prevented to reduce the frictional resistance of the piston. Both effects allow for an increase in engine output and an improvement in the specific consumption of fuel.

For example, Japanese Patent Application Laid-open No.1-227850 describes an engine in which a groove-shaped circulation chamber is provided for the circulation of cooling water, which is defined in an upper portion of a cylinder liner to enhance the cooling ability. This prevents the seizure of the piston, prevents the leakage of gas and inhibits knocking. The Japanese Patent Application also discloses a convection chamber for natural convection of the cooling water, where the chamber is provided in a lower portion of the cylinder liner to prevent the over-cooling, thereby providing a reduction in the frictional resistance of the piston.

Japanese Patent Application Laid-open No.3-67052 describes an engine, which is designed so that an upper portion of a cylinder liner is cooled by means of a water jacket, and includes a space defined in a lower portion of the cylinder liner to communicate with a crank chamber, thereby preventing the over-cooling.

Frictional losses at slide portions of the cylinder liner and the piston are produced by (1) a frictional resistance due to the shearing of an oil film of a lubricating oil generated by the sliding movement of a piston ring and (2) the drag resistance of a surplus amount of the lubricating oil adhered to the cylinder liner. Therefore, if the viscosity of the lubricating oil is reduced to as low a value as possible, in a range enough to maintain an oil film forming ability, the friction loss is decreased. Hence, it is desirable that the temperature of the slide portions be increased to reduce the viscosity of the lubricating oil. For this purpose, it is a conventional practice to prevent the over-cooling of the lower portion of the cylinder liner (the position between an intermediate portion and a bottom dead center of the piston) by altering the structure of the cooling circuit or the structure of the water jacket. The internal pressure in the lower portion of the cylinder liner is low and hence, the lubricating condition is not severe, and the lower portion of the cylinder liner can be adjusted to a temperature higher than that in the prior art to decrease the frictional losses. In the prior art, however, the ability to cool the lower portion of the cylinder liner is merely reduced, and the lower portion is not positively heated. Therefore, the frictional losses are not sufficiently reduced.

SUMMARY OF THE INVENTION

Accordingly, it is an object of the present invention to provide an appropriate temperature profile to the cylinder wall to minimize the friction loss produced at the slide portions of the cylinder wall and the piston.

To achieve the above object, according to a first aspect of the present invention, there is provided a system for controlling the temperature of a cylinder wall in an engine, comprising a heating means for heating at least a portion of a cylinder wall in a vicinity of a bottom dead center of a piston which is slidably guided in the cylinder wall; a cooling means for cooling at least the portion of the cylinder wall in the vicinity of the bottom dead center of the piston, a temperature detecting means for detecting a temperature of the cylinder wall, and a control means for controlling the heating means and the cooling means, based on the detected temperature of the cylinder wall, so that the temperature of the cylinder wall is brought into a target temperature.

With the above arrangement, the heating means and the cooling means for heating and cooling at least the portion of the cylinder wall in the vicinity of the bottom dead center of the piston, and are controlled by the control means, so that the temperature of the cylinder wall is brought into the target temperature. Therefore, the temperature of the portion of the cylinder wall in the vicinity of the bottom dead center of the piston can be brought into a sufficiently high temperature in such a range enabling an oil film of a lubricating oil to be ensured, and the viscosity of the lubricating oil can be decreased to minimize the friction loss between slide portions of the cylinder wall and the piston, thereby providing an increase in engine output, a reduction in amount of fuel consumed and a reduction in amount of lubricating oil consumed.

According to a second aspect of the present invention, the heating means heats the cylinder wall by an exhaust gas flowing through a gas jacket defined in a cylinder block, and the cooling means cools the cylinder wall by fresh air flowing through the gas jacket defined in the cylinder block.

With the above arrangement, the cylinder wall is heated by permitting the exhaust gas to flow through the gas jacket, and cooled by permitting the fresh air to flow through the gas jacket. Therefore, the temperature of the cylinder wall can be increased quickly and controlled properly to a desired temperature.

According to a third aspect of the present invention, the heating means comprises a heat transfer member for transferring the heat of an exhaust gas to a cylinder block, and the cooling means cools the heat transfer member by cooling water flowing through a water jacket defined in the heat transfer member.

With the above arrangement, the heat of the exhaust gas is transferred to the cylinder block through the heat transfer member to heat the cylinder wall, and cooling water is permitted to flow through the water jacket defined in the heat transfer member to cool the heat transfer member, thereby cooling the cylinder wall. Therefore, the temperature of the cylinder wall can be increased quickly and controlled properly to a desired temperature.

According to a fourth aspect of the present invention, there is provided a system for controlling the temperature of a cylinder wall in an engine, comprising an upper water jacket facing a portion of a cylinder wall on which a piston is slidably guided, where the upper water jacket is adjacent to a top dead center of the piston, a lower water jacket facing another portion of the cylinder wall, which is adjacent to a bottom dead center of the piston, an upper cylinder portion temperature detecting means for detecting a temperature of an upper portion of the cylinder wall adjacent to the top dead center of the piston, a lower cylinder portion temperature detecting means for detecting a temperature of a lower portion of the cylinder wall adjacent to the bottom dead center of the piston, an upper cooling circuit for controlling cooling water flowing through the upper water jacket to converge the temperature of the upper portion of the cylinder wall detected by the upper cylinder wall temperature detecting means to a target temperature for the upper portion of the cylinder wall, and a lower cooling circuit for controlling the cooling water flowing through the lower water jacket to converge the temperature of the lower portion of the cylinder wall detected by the lower cylinder wall temperature detecting means to a target temperature for the lower portion of the cylinder wall.

With the above arrangement, the cooling water flowing through the upper water jacket facing the portion of the cylinder wall adjacent to the top dead center of the piston is controlled by the upper cooling circuit, and the cooling water flowing through the lower water jacket facing the portion of the cylinder wall adjacent to the bottom dead center of the piston is controlled by the lower cooling circuit. Therefore, the temperature of the upper portion of the cylinder wall liable to be subjected to a heat load produced by the combustion and the temperature of the lower portion of the cylinder wall that may or may not be subjected to the heat load produced by the combustion can be controlled individually. Thus, at the portion of the cylinder wall adjacent to the top dead center of the piston, the over-heating of the engine can be prevented to maintain the temperature of an oil film at an appropriate point, while preventing an abnormal combustion, thereby decreasing the frictional force to decrease the friction loss. In addition, at the portion of the cylinder wall adjacent to the bottom dead center of the piston, the temperature of the oil film can be increased up to a point as high as possible in such a range that the breaking of the oil film does not occur, thereby reducing the viscosity to provide an increase in engine output, a reduction in amount of fuel consumed and a reduction in amount of lubricating oil consumed.

According to a fifth aspect of the present invention, the lower cooling circuit includes a heat exchanger for heating the cooling water by the heat of an exhaust gas.

With the above arrangement, the heat exchanger for heating the cooling water by the heat of the exhaust gas is provided in the lower cooling circuit. Therefore, it is possible to heat the cooling water by utilizing the heat of the exhaust gas without provision of a special heat source to contribute to a reduction in cost.

According to a sixth aspect of the present invention, the lower cooling circuit includes a heat exchanger for heating the cooling water by the heat of an electric heater.

With the above arrangement, the heat exchanger for heating the cooling water by the heat of the electric heater is provided in the lower cooling circuit. Therefore, it is possible to heat the cooling water before starting the engine to increase the temperature of the lower cylinder wall, thereby contributing to a decrease in friction loss and an improvement in emission.

According to a seventh aspect of the present invention, there is provided a system for controlling the temperature of a cylinder wall in an engine, comprising an upper water jacket facing a portion of a cylinder wall on which a piston is slidably guided, where the upper water jacket is adjacent to a top dead center of the piston, and a lower water jacket facing another portion of the cylinder wall adjacent to a bottom dead center of the piston, wherein cooling water exiting a radiator is passed through the upper water jacket and then through the lower water jacket back to the radiator.

With the above arrangement, the cooling water passed through the upper water jacket facing the portion of the cylinder wall adjacent to the top dead center of the piston and having an increased temperature is supplied to the lower water jacket facing the portion of the cylinder wall adjacent to the bottom dead center of the piston. Therefore, the temperature of the lower cylinder wall has been increased up to a point higher than that in the prior art in which the cooling water is permitted to flow from a lower portion of a cylinder block toward an upper portion of the cylinder block. Thus, the temperature of an oil film at the portion of the cylinder wall adjacent to the bottom dead center of the piston can be brought into a point as high as possible to reduce the viscosity, and the frictional force can be decreased to provide an increase in engine output, a reduction in amount of fuel consumed and a reduction in amount of lubricating oil consumed.

According to an eighth aspect of the present invention, the cooling water passed through the upper water jacket is supplied to a site corresponding to each cylinder at a lower end of the lower water jacket through a gallery.

With the above arrangement, the cooling water supplied from the upper water jacket to the lower water jacket flows independently into each of the cylinders through the gallery. Therefore, the temperatures of the walls of the cylinders can be equalized to decrease the fluctuation in combustion and the variation in torque. Moreover, the gallery communicates with the lower end of the lower water jacket and hence, when the cooling water is poured into the lower water jacket, the withdrawal of air is improved.

The above and other objects, features and advantages of the invention will become apparent from the following description of the preferred embodiments taken in conjunction with the accompanying drawings.

BRIEF DESCRIPTION OF THE DRAWINGS

FIGS. 1 to 7 show a first embodiment of the present invention, wherein

FIG. 1 is a view showing the entire arrangement of a cylinder-wall temperature controlling systems;

FIG. 2 graph showing the relationship between the temperature of a cylinder wall and the frictional force;

FIG. 3 is a graph for explaining a technique for determining a target temperature for an upper cylinder wall at a low rotational speed of an engine and at a high engine load;

FIG. 4 is a graph for explaining a technique for determining a target temperature for the upper cylinder wall at a high rotational speed of an engine and at a low engine load;

FIG. 5 is a graph for explaining a technique for determining a target temperature for the upper cylinder wall at a low rotational speed of an engine and at a low engine load, as well as at a high rotational speed of an engine and at a high engine load;

FIG. 6 is a graph for explaining a technique for determining a target temperature for a lower cylinder wall;

FIG. 7 is a flow chart of a cylinder wall temperature control routine;

FIGS. 8 and 9 show a second embodiment of the present invention, wherein FIG. 8 is a view showing the entire arrangement of a cylinder-wall temperature controlling system;

FIG. 9 is a sectional view taken along a line 9—9 in FIG. 8;

FIGS. 10 to 12 show a third embodiment of the present invention, wherein FIG. 10 is a view showing the entire arrangement of a cylinder wall temperature controlling system;

FIG. 11 is a view taken in a direction of an arrow 11 in FIG. 10;

FIG. 12 is a flow chart of a cylinder wall temperature control routine;

FIGS. 14 to 16 show a fifth embodiment of the present invention, wherein FIG. 14 is a view showing the entire arrangement of a cylinder wall temperature controlling system;

FIG. 15 is a view taken in a direction of an arrow 15 in FIG. 14; and FIG. 16 is a flow chart of a cylinder wall temperature control routine.

DESCRIPTION OF THE PREFERRED EMBODIMENTS

A first embodiment of the present invention will now be described with reference to FIGS. 1 to 7.

Figure 1:
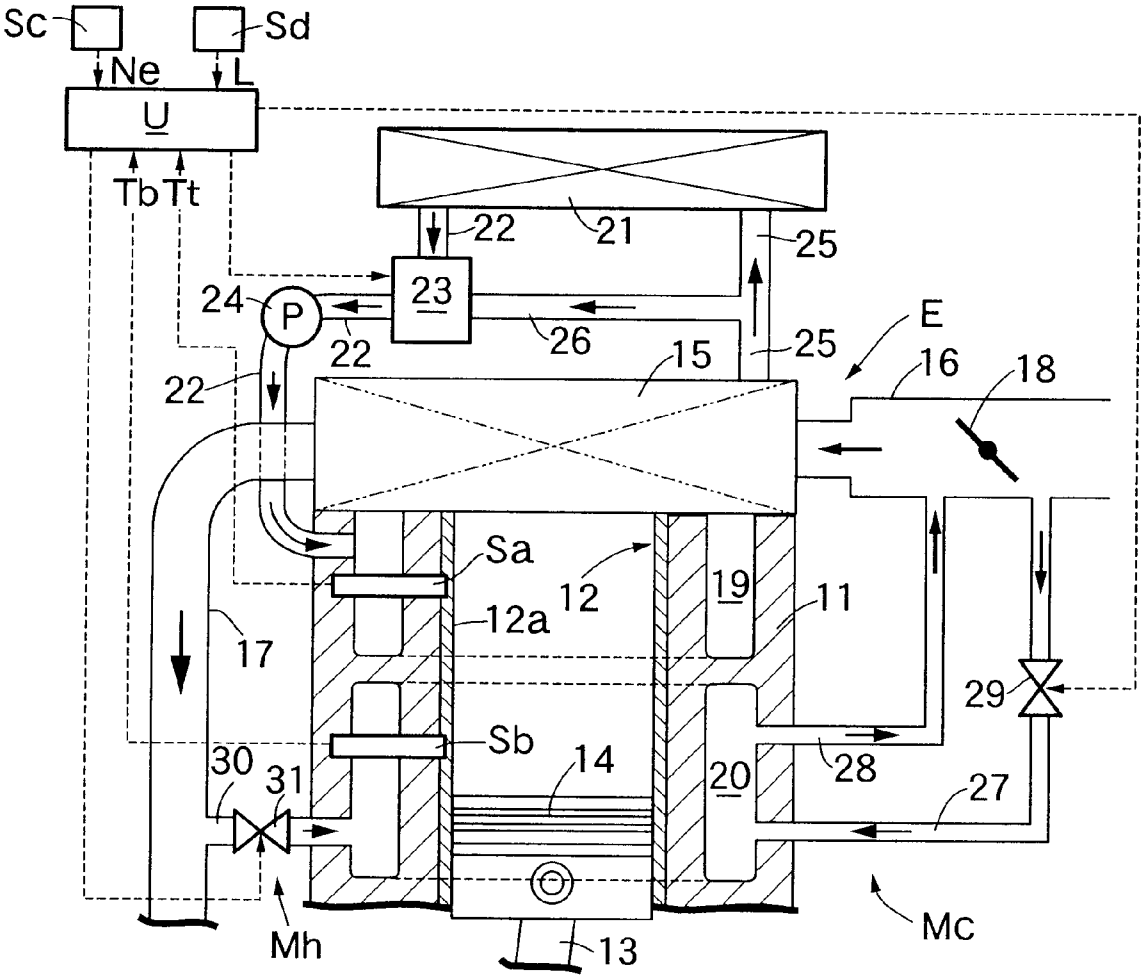

Referring to FIG. 1, a piston 14 connected to a crankshaft (not shown) through a connecting rod 13 is slidably carried on a cylinder liner 12 fixed within a cylinder block 11 of an engine E. An intake passage 16 and an exhaust passage 17 are connected to a cylinder head 15 coupled to a top surface of the cylinder block 11, and a throttle valve 18 is mounted in the intake passage 16. A water jacket 19 is defined in an upper portion of the cylinder block 11, namely, at a location closer to a top dead center of the piston to surround an outer periphery of the cylinder liner 12, and a gas jacket 20 is defined in a lower portion of the cylinder block 11, namely, at a location closer to a bottom dead center of the piston to surround the outer periphery of the cylinder liner 12.

A radiator 21 and the water jacket 19 in the cylinder block 11 are connected to each other by a cooling-water supply passage 22, and a cooling-water flow path switch-over valve 23 comprising an electromagnetic valve and a cooling-water pump 24 for pumping cooling water are mounted in the cooling-water supply passage 22. The cooling-water pump 24 may be driven by the crankshaft of the engine E or by an electric motor. A water jacket (not shown) provided in the cylinder head 15 and connected to a downstream portion of the water jacket 19 in the cylinder block 11 is connected to the radiator 21 through a cooling-water discharge passage 25. The cooling-water discharge passage 25 and the cooling-water flow path switch-over valve 23 are connected to each other through a bypass passage 26.

A portion of the intake passage 16 upstream of the throttle valve 18 and a portion of the intake passage 16 downstream of the throttle valve 18 are connected to the gas jacket 20 through a fresh-air supply passage 27 and a fresh-air and exhaust gas discharge passage 28, and a fresh-air supply valve 29 comprising an electromagnetic valve is mounted in the fresh-air supply passage 27. The discharge passage 17 is connected to the gas jacket 20 through an exhaust gas supply passage 30, and an exhaust gas supply valve 31 comprising an electromagnetic valve is mounted in the exhaust gas supply passage 30.

The gas jacket 20, the exhaust gas supply passage 30 and the exhaust gas supply valve 31 constitute a heating means Mh of the present invention, and the gas jacket 20, the fresh-air supply passage 27 and the fresh-air supply valve 20 constitute a cooling means Mc of the present invention.

An electronic control unit U receives signals from an upper cylinder wall temperature detecting means Sa for detecting the temperature Tt of an upper cylinder wall at the upper portion (the location closer to the top dead center of the piston) of the cylinder liner 12, a lower cylinder wall temperature detecting means Sb for detecting the temperature Tb of a lower cylinder wall at the lower portion (the location between an intermediate portion and the bottom dead center of the piston) of the cylinder liner 12, an engine-rotational speed detecting means Sc for detecting a rotational speed Ne of the engine, and an engine load detecting means Sd for detecting an engine load L (a throttle opening degree or an absolute pressure within an intake pipe). The electronic control unit U controls the operations of the cooling-water flow path switch-over valve 23 mounted in the cooling-water supply passage 22, the fresh-air supply valve 29 mounted in the fresh-air supply passage 27 and the exhaust gas supply valve 31 mounted in the exhaust gas supply passage 30.

The operation of the embodiment of the present invention having the above-described arrangement will be described below.

Figure 2:
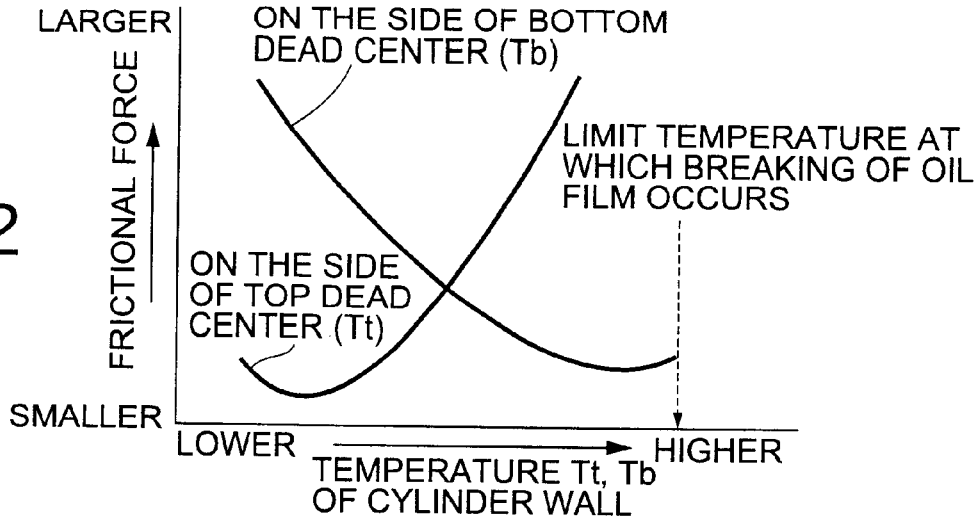

FIG. 2 shows the relationship between the temperatures Tt and Tb of the cylinder walls (the temperature of a cylinder wall 12*a*) and the frictional force between the piston 14 and the cylinder wall 12*a*. In the upper portion of the cylinder liner 12, the speed of the piston is low, but the heat load from a combustion chamber is extremely large. Therefore, even if the temperature Tt of the upper cylinder wall is low, the viscosity of a lubricating oil is decreased rapidly, and the temperature Tt of the upper cylinder wall, at which the frictional force is smallest, is relative low.

On the other hand, in the intermediate portion of the cylinder liner 12, the speed of the piston is high and hence, the shearing force of the lubricating oil is increased, resulting in an increased frictional force. In the lower portion of the cylinder liner 12, the heat load from the combustion chamber is small. Therefore, the temperature Tb of the lower cylinder wall is difficult to increase and for this reason, the viscosity pf the lubricating oil is increased, resulting in an increased frictional force. From the foregoing, in the intermediate and lower portions of the cylinder liner 12, the frictional force is decreased, as the temperature Tb of the lower cylinder wall is increased. However, if the temperature Tb of the lower cylinder wall is too high, an oil film is broken, whereby a slide portion is damaged, or the cylinder liner 12 is thermally deformed. Therefore, an upper limit exists at a higher level than the temperature Tb of the lower cylinder wall at which the frictional force is minimum.

With the foregoing in view, a target temperature TtOBJ which is a target value for the temperature Tt of the upper cylinder wall and a target temperature TbOBJ which is a target value for the temperature Tb of the lower cylinder wall are searched from a map in the following manner, based on an engine-rotational speed Ne detected by the engine-rotational speed detecting means Sc and an engine load L detected by the engine load detecting means Sd.

Figure 3:
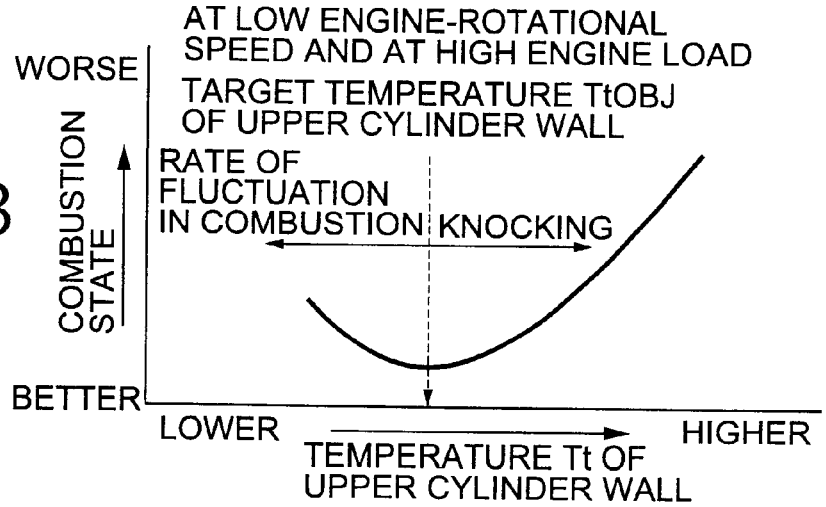

The graph shown in FIG. 3 is a base for a map for searching of a target temperature TtOBJ of the upper cylinder wall at a low rotational speed of the engine and at a high engine load. A temperature Tt of the upper cylinder wall, at which the combustion state is the best at an engine-rotational speed Ne and at an engine load L at that time, is defined as a target temperature TtOBJ for the upper cylinder wall.

Figure 4:
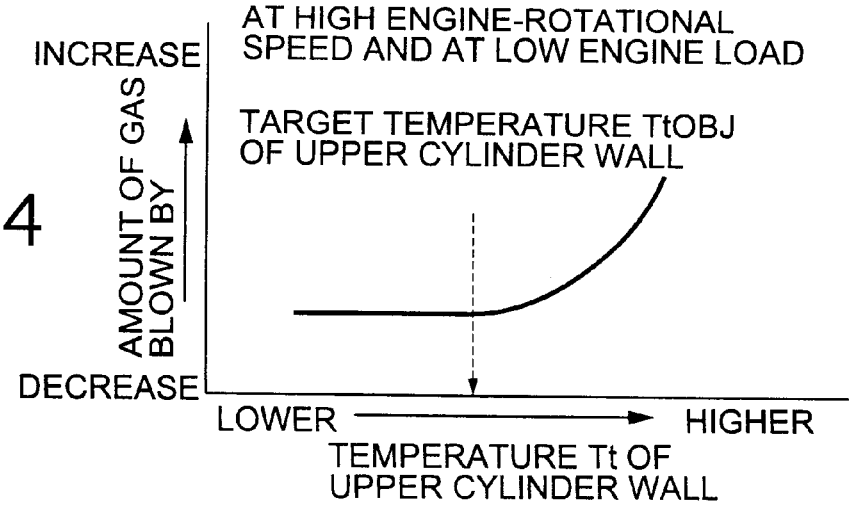

The graph shown in FIG. 4 is a base for a map for searching of a target temperature TtOBJ of the upper cylinder wall at a high rotational speed of the engine and at a low engine load. A temperature Tt of the upper cylinder wall, at which the amount of gas blown by is not decreased even if the temperature Tt of the upper cylinder wall is further lowered at a rotational speed Ne of the engine and at an engine load L at that time, is defined as a target temperature TtOBJ for the upper cylinder wall.

Figure 5:
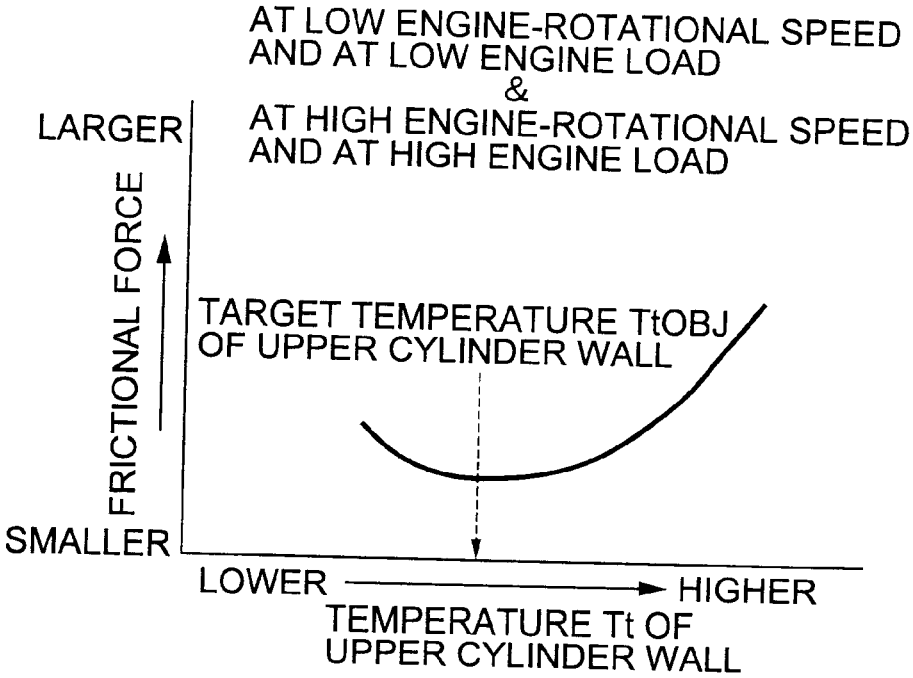

The graph shown in FIG. 5 is a base for a map for searching of a target temperature TtOBJ for the upper cylinder wall at a low rotational speed of the engine and at a low engine load as well as at a high rotational speed of the engine and at a high engine load. A temperature Tt of the upper cylinder wall, at which the frictional force between the piston 14 and the cylinder wall 12*a* is minimum at a rotational speed Ne of the engine and at an engine load L at that time, is defined as a target temperature TtOBJ for the upper cylinder wall.

Figure 6:
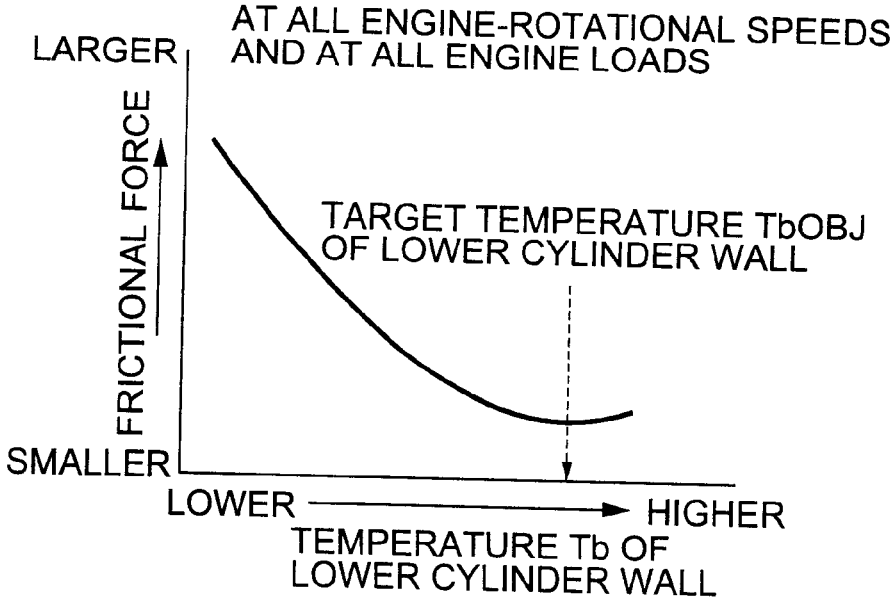

The graph shown in FIG. 6 is a base for a map for searching of a target temperature TbOBJ for the lower cylinder wall at all rotational speeds of the engine and at all engine loads. A temperature Tb of the lower cylinder wall, at which the frictional force between the piston 14 and the cylinder wall 12*a* is minimum, is defined as a target temperature TbOBJ for the lower cylinder wall.

Figure 7:
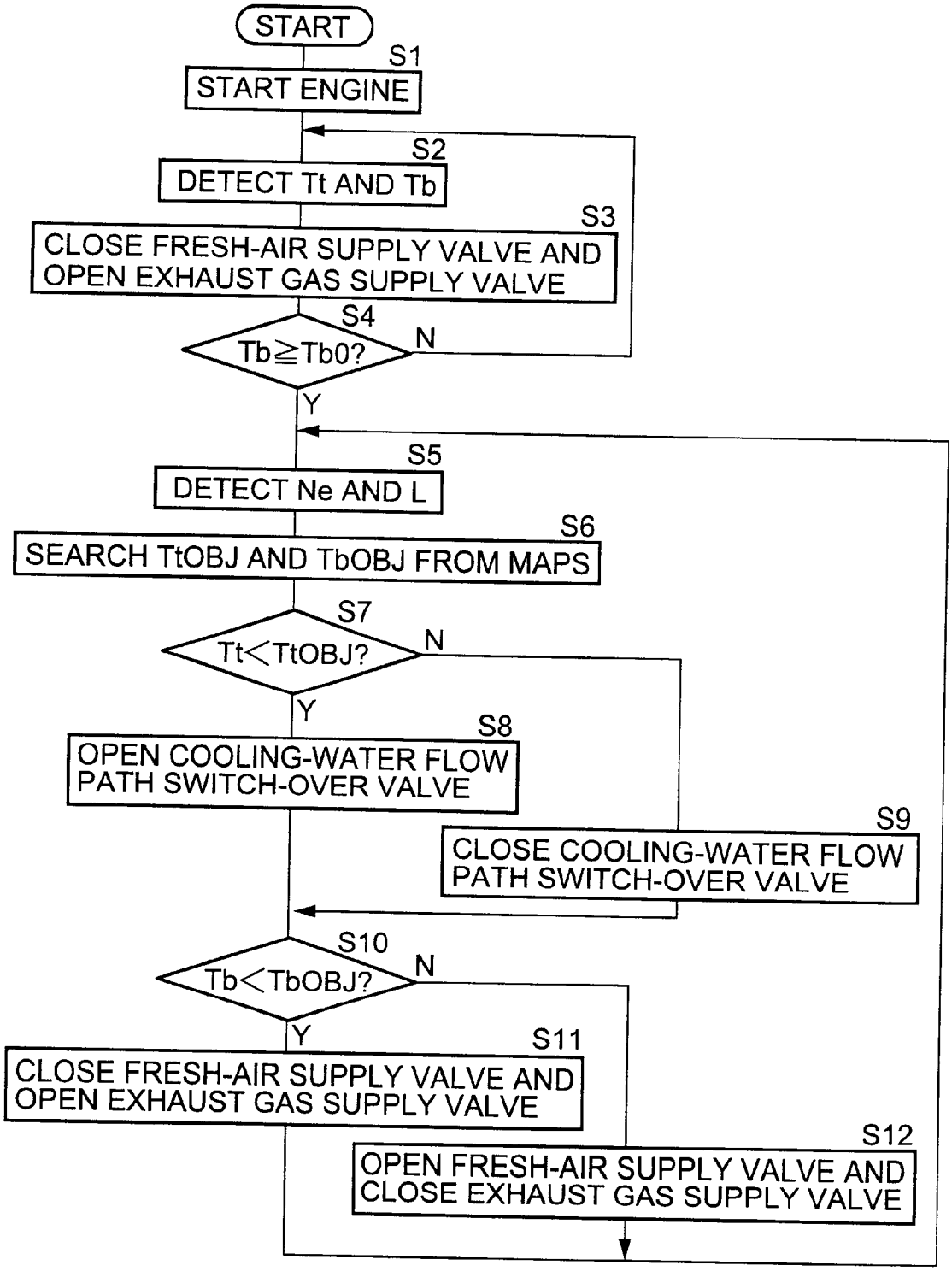

The particular contents of the control of the temperature of the cylinder wall will be described below with reference to a flow chart in FIG. 7.

First, when the engine E is started at Step S1, a temperature Tt of the upper cylinder wall and a temperature Tb of the lower cylinder wall are detected by the upper cylinder wall temperature detecting means Sa and the lower cylinder wall temperature detecting means Sb at Step S2, respectively. Then, at Step S3, the fresh-air supply valve 29 mounted in the fresh-air supply passage 27 is closed and at the same time, the exhaust gas supply valve 31 mounted in the exhaust gas supply passage 30 is opened, thereby permitting an exhaust gas flowing through the exhaust passage 17 to be supplied to the gas jacket 20 provided in the lower portion of the cylinder block 11. As a result, the exhaust gas supplied from the exhaust passage 17 through the exhaust gas supply passage 30 to the gas jacket 20 is supplied from the gas jacket 20 through the fresh-air and exhaust gas discharge passage 28 to the intake passage 16. The exhaust gas supplied to the intake passage 16 is utilized as an EGR gas and hence, it is unnecessary to provide a special EGR passage, which can contribute to a reduction in number of parts and an increase in reliability.

By supplying the exhaust gas to the gas jacket 20 simultaneously with the starting of the engine E in the above manner, the temperature Tb of the lower cylinder wall can be increased quickly to reduce the frictional force between the piston 14 and the cylinder wall 12*a*.

When the temperature Tb of the lower cylinder wall is increased up to a feedback control starting initial value Tb0 at subsequent Step S4, an engine-rotational speed Ne and an engine load L are detected at Step S5 by the engine-rotational speed detecting means Sc and the engine-load detecting means Sd, respectively in order to start the feedback control of the temperature Tt of the upper cylinder wall and the temperature Tb of the lower cylinder wall. Thereafter, a target temperature TtOBJ for the upper cylinder wall and a target temperature TbOBJ for the lower cylinder wall are searched from the maps at Step S6 (see FIGS. 3 to 6).

If the temperature Tt of the upper cylinder wall is lower than the target temperature TbOBJ for the upper cylinder wall at subsequent Step S7, the cooling-water flow path switch-over valve 23 is opened at Step S8 to connect the bypass passage 26 to the cooling-water supply passage 22, so that the cooling water passed through the water jacket 19 in the engine E is circulated around the radiator 21, thereby increasing the temperature Tt of the upper cylinder wall toward the target temperature TtOBJ for the upper cylinder wall. On the other hand, if the temperature Tt of the upper cylinder wall is equal to or higher than the target temperature TtOBJ for the upper cylinder wall at Step S7, the cooling-water flow path switch-over valve 23 is closed at Step S9 to disconnect the bypass passage 26 from the cooling-water supply passage 22, so that the cooling water passed through the water jacket 19 in the engine E is supplied to the radiator 21, thereby lowering the temperature Tt of the upper cylinder wall toward the target temperature TtOBJ for the upper cylinder wall.

In this manner, the temperature Tt of the upper cylinder wall is controlled in a feedback manner so as to be converged to the target temperature TtOBJ for the upper cylinder wall. Thus, the over-heating of the engine E can be prevented to maintain the temperature of the oil film on the upper portion of the cylinder wall 12*a* (in the vicinity of the top dead center of the piston) at an appropriate point, while enhancing the durability, and the frictional force can be decreased to reduce the friction loss. Moreover, the target temperature TtOBJ for the upper cylinder wall is determined at a low engine-rotational speed and at a high engine load to provide a best combustion state, and hence, an abnormal combustion in the engine E can be prevented effectively. On the other hand, the target temperature TtOBJ for the upper cylinder wall is determined at a high engine-rotational speed and at a low engine load, so that the amount of gas blown by is smallest, and hence, the amount of gas blown by can be suppressed to the minimum.

If the temperature Tb of the lower cylinder wall is lower than the target temperature TbOBJ for the lower cylinder wall at subsequent Step S10, the fresh-air supply valve 29 is closed and at the same time, the exhaust gas supply valve 31 is opened at Step S11, so that the exhaust gas flowing through the exhaust gas passage 17 is supplied to the gas jacket 20 provided in the lower portion of the cylinder block 11. Thus, the exhaust gas, whereby the temperature Tb of the lower cylinder wall is increased toward the target temperature TbOBJ for the lower cylinder wall, heats the lower portion of the cylinder block 11. On the other hand, if the temperature Tb of the lower cylinder wall is equal to or higher than the target temperature TbOBJ for the lower cylinder wall at Step S10, the fresh-air supply valve 29 is opened and at the same time, the exhaust gas supply valve 31 is closed at Step S12, so that the fresh air flowing through the fresh air passage 16 is supplied to the gas jacket 20 provided in the lower portion of the cylinder block 11. Thus, the fresh air, whereby the temperature Tb of the lower cylinder wall is lowered toward the target temperature TbOBJ for the lower cylinder wall, cools the lower portion of the cylinder block 11.

In this way, the exhaust gas is permitted to flow to the gas jacket 20 to heat the cylinder wall 12*a* and hence, the temperature Tb of the lower cylinder wall can be increased quickly. In addition, the fresh air is permitted to flow to the gas jacket 20 to cool the cylinder wall 12*a* and hence, the temperature Tb of the lower cylinder wall Tb can be controlled precisely to a desired temperature.

Additionally, the lower portion (the portion between the intermediate portion and the bottom dead center of the piston) of the cylinder wall 12*a* can be brought into a temperature higher than that in the prior art to reduce the viscosity of the oil film by feed-back control of the temperature Tb of the lower cylinder wall to converge temperature Tb to the target temperature TbOBJ for the lower cylinder wall. Thus, it is possible to reduce the frictional force between the slide portions of the piston 14 and the cylinder wall 12*a* to reduce the friction loss, thereby providing an increase in output and a reduction in amount of fuel consumed. In addition, it is possible to reduce the oil film adhered to the cylinder wall 12*a* to reduce the amount of lubricating oil consumed. Further, since the fresh-air supply passage 27 and the fresh-air and exhaust gas discharge passage 28 constitute a passage extending around the throttle valve 18, the fresh-air supply valve 29 can be opened properly, and the throttle valve 18 can be utilized as an idle port between the fresh-air supply passage 27 and the fresh-air and exhaust gas discharge passage 28.

Figure 8:
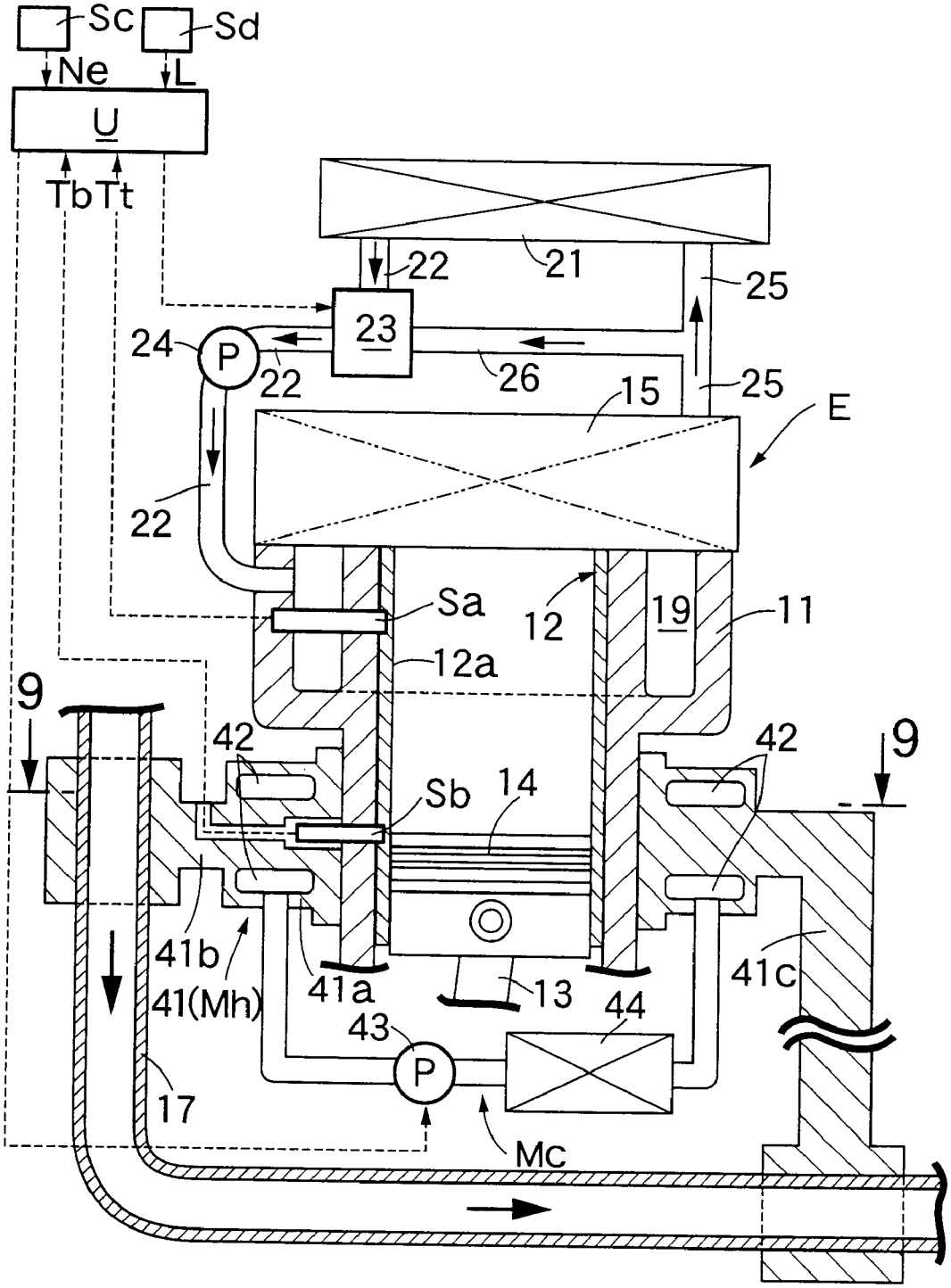
Figure 9:
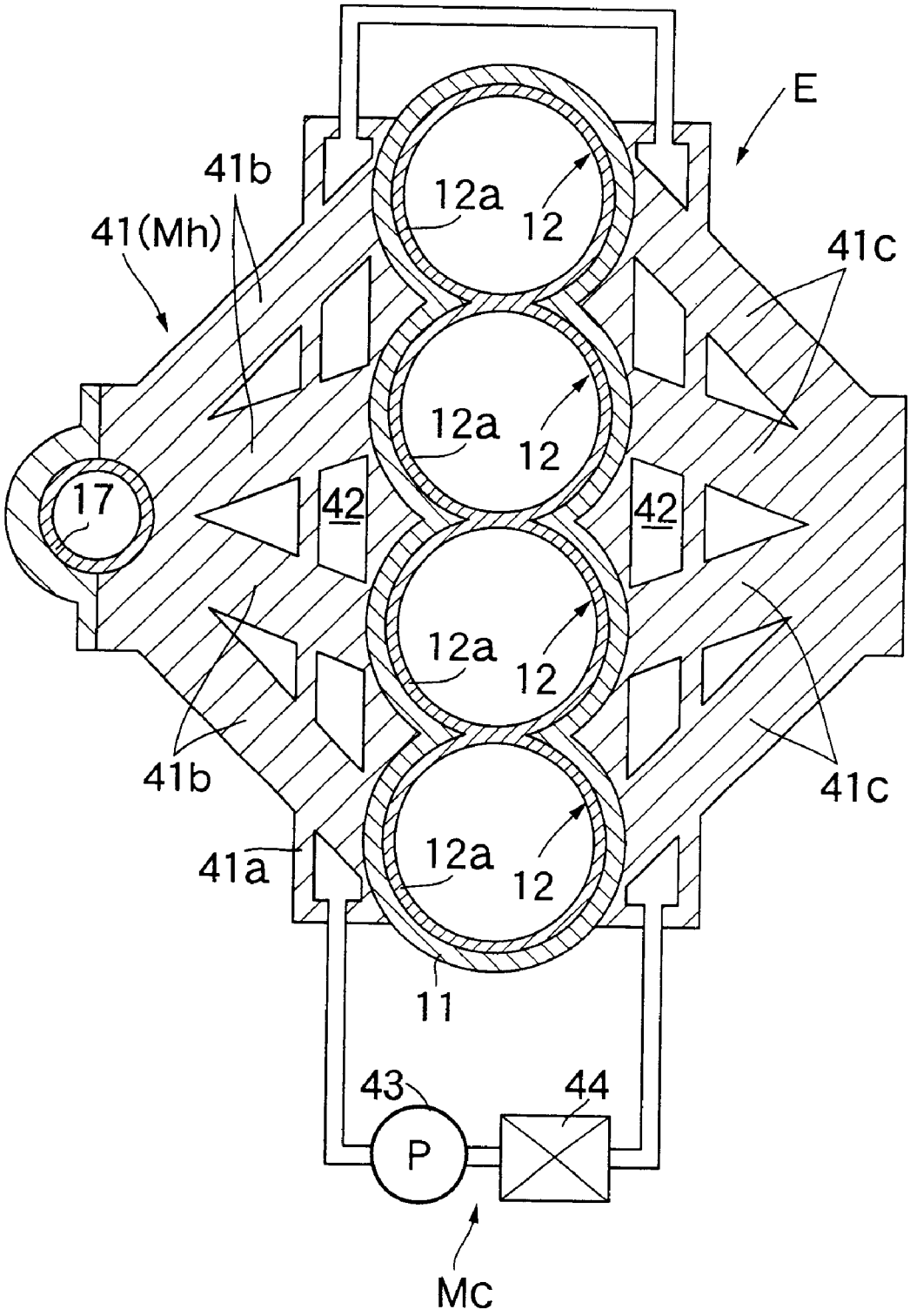

A second embodiment of the present invention will now be described with reference to FIGS. 8 and 9.

The second embodiment is different from the first embodiment in respect of a technique for controlling the temperature Tb of the lower cylinder portion. More specifically, a heat transfer member 41 connects an exhaust passage 17 in the engine E and a lower portion of a cylinder block 11 to each other. The heat transfer member is comprised of a heating and cooling portion 41a surrounding an outer periphery of the cylinder block 11, and heat transfer portions 41*b* and 41*c* connecting the exhaust passage 17 to the heating and cooling portion 41*a*. A water jacket 42 is provided in the heating and cooling portion 41*a* of the heat transfer member 41, and water passed through an electric cooling-water pump 43 and an exclusive radiator 44 controlled by the electronic control unit U is circulated within the water jacket 42.

The heat transfer member 41 constitutes a heating means Mh of the present invention, and the water jacket 42, the electric cooling-water pump 43 and the radiator 44 constitute a cooling means Mc of the present invention.

When the temperature Tb of the lower cylinder wall is lower than the target temperature TbOBJ for the lower cylinder wall, the electric cooling-water pump 43 is stopped, so that the heat of the exhaust passage 17, through which an exhaust gas having a high temperature flows, is transmitted to the lower portion of the cylinder block 11 through the heat transfer member 41, thereby increasing the temperature Tb of the lower cylinder wall toward the target temperature TbOBJ of the lower cylinder wall. On the other hand, when the temperature Tb of the lower cylinder wall is equal to or higher than the target temperature TbOBJ for the lower cylinder wall, the electric cooling-water pump 43 is driven to supply the cooling water into the water jacket 42 in the heat transfer member 41, thereby lowering the temperature Tb of the lower cylinder wall toward the target temperature TbOBJ of the lower cylinder wall.

In the above manner, a function and an effect similar to those in the first embodiment can be achieved even in the second embodiment.

A third embodiment of the present invention will be described with reference to FIGS. 10 to 12.

Figure 10:
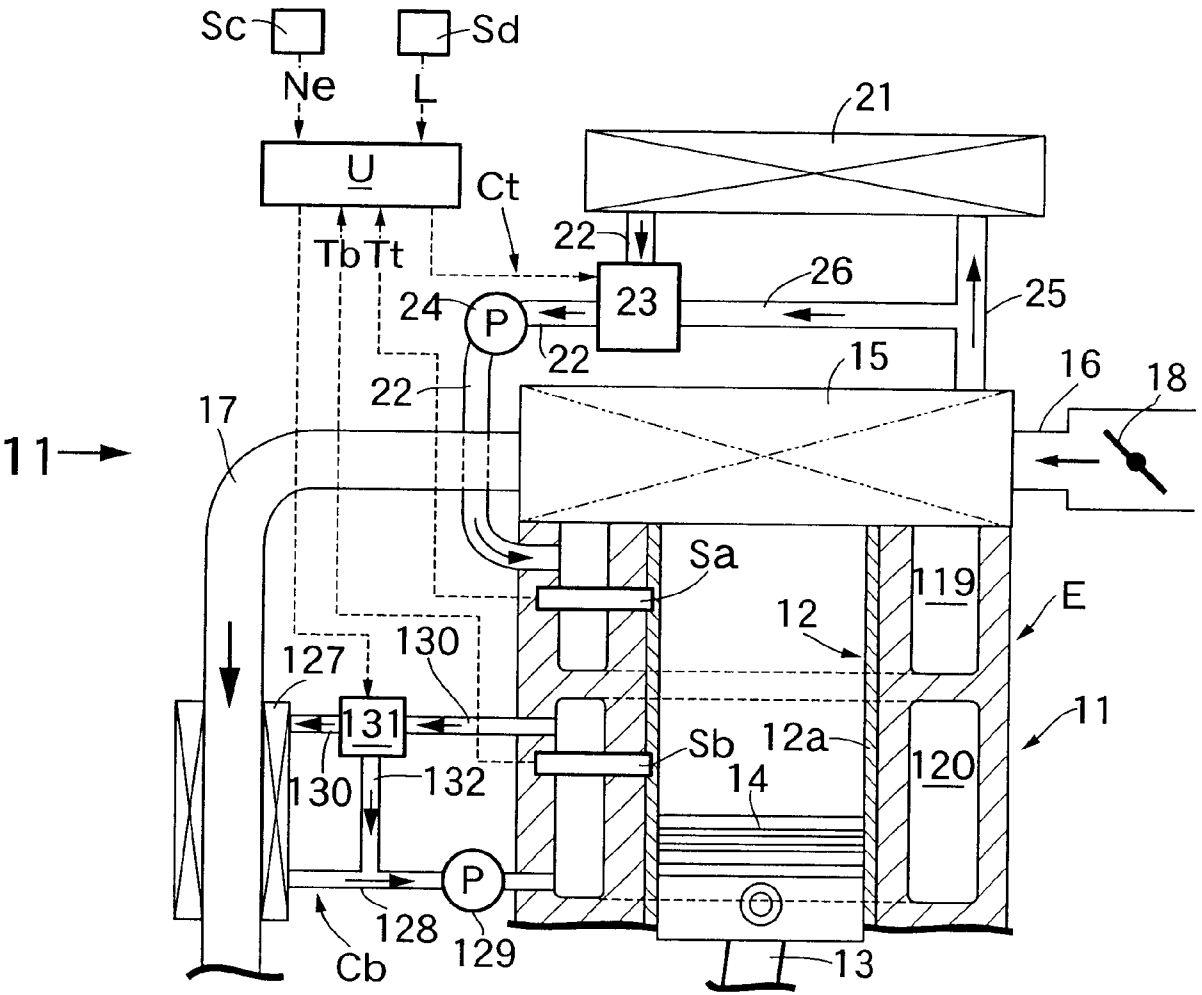
Figure 11:
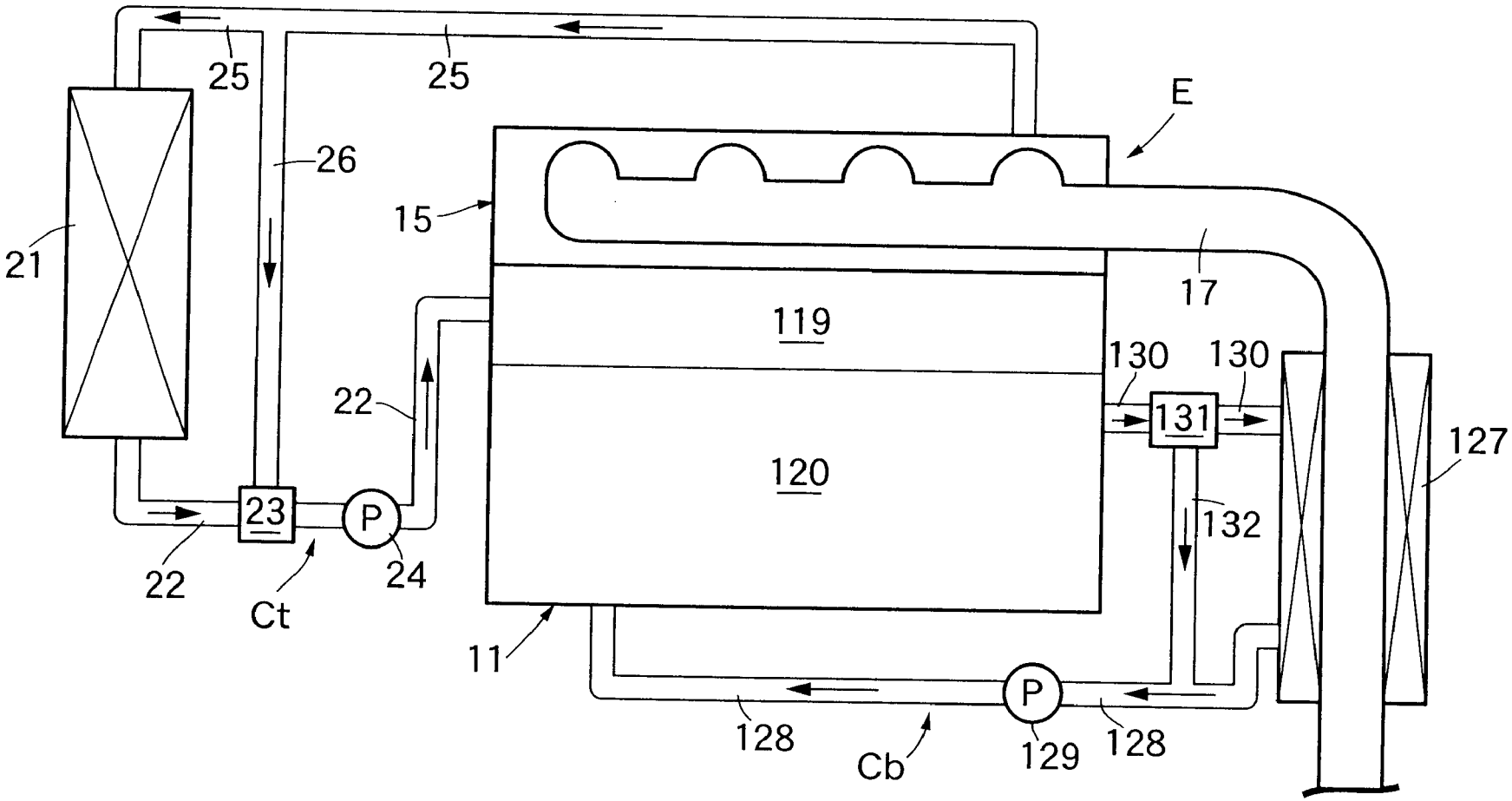
Figure 12:
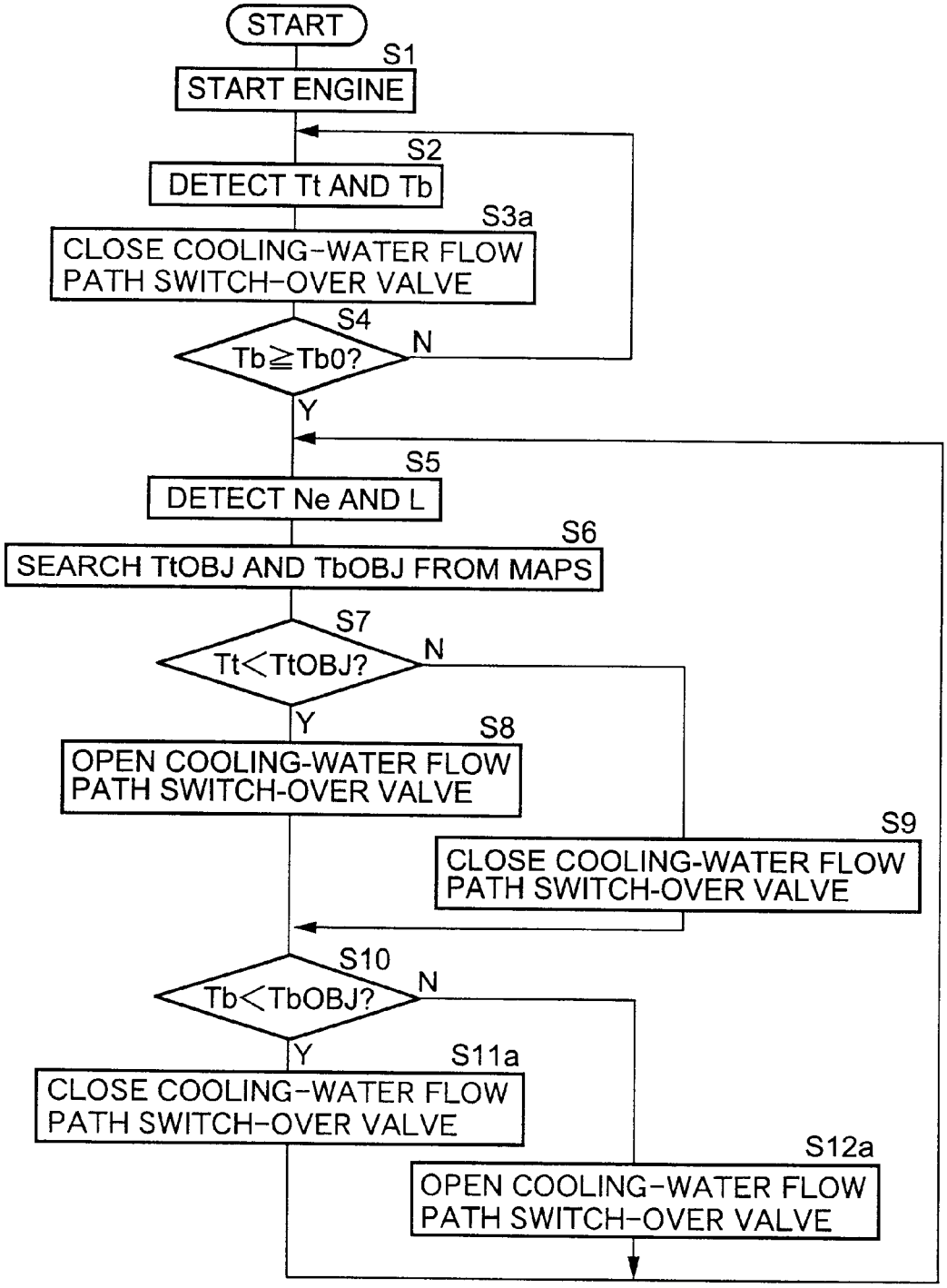

As shown in FIGS. 10 and 11, a piston 14 connected to a crankshaft (not shown) through a connecting rod 13 is slidably carried on a cylinder liner 12 fixed within a cylinder block 11 of an engine E. An intake passage 16 and an exhaust passage 17 are connected to a cylinder head 15 coupled to a top surface of the cylinder block 11, and a throttle valve 18 is mounted in the intake passage 16. An upper water jacket 119 is defined in an upper portion of the cylinder block 11, namely, at a location closer to a top dead center of the piston to surround an outer periphery of the cylinder liner 12, and a lower water jacket 120 is defined in a lower portion of the cylinder block 11, namely, at a location closer to a bottom dead center of the piston to surround the outer periphery of the cylinder liner 12.

A radiator 21 and the upper water jacket 119 in the cylinder block 11 are connected to each other by a cooling-water supply passage 22, and a cooling-water flow path switch-over valve 23 comprising an electromagnetic valve and a cooling-water pump 24 for pumping cooling water are mounted in the cooling-water supply passage 22. The cooling-water pump 24 may be driven by the crankshaft of the engine E or by an electric motor. A water jacket (not shown) provided in the cylinder head 15 and connected to a downstream portion of the upper water jacket 19 in the cylinder block 11 is connected to the radiator 21 through a cooling-water discharge passage 25. The cooling-water passage 25 and the cooling-water flow path switch-over valve 23 are connected to each other through a bypass passage 26.

A heat exchanger 127 for heat-exchanging the cooling water and an exhaust gas in the exhaust gas passage 17 with each other is provided to surround an outer periphery of the exhaust gas passage 17. An electrically-operated cooling-water pump 129 is mounted in a cooling-water supply passage 128 extending from the heat exchanger 127 to the lower water jacket 120, and a cooling-water flow path switch-over valve 131 is mounted in a cooling-water discharge passage 130 extending from the lower water jacket 120 to the heat exchanger 127. The cooling-water flow path switch-over valve 131 and the cooling-water supply passage 128 are connected to each other through a bypass passage 132.

The upper water jacket 119, the cooling-water pump 24 and the cooling-water flow path switch-over valve 23 constitute an upper cooling circuit Ch of the present invention, and the lower water jacket 120, the cooling water pump 129 and the cooling-water flow path switch-over valve 131 constitute a lower cooling circuit Cb of the present invention.

An electronic control unit U receives signals from an upper cylinder wall temperature detecting means Sa for detecting the temperature Tt of an upper cylinder wall at the upper portion (the location closer to the top dead center of the piston) of the cylinder liner 12, a lower cylinder wall temperature detecting means Sb for detecting the temperature Tb of a lower cylinder wall at the lower portion (the location between an intermediate portion and the bottom dead center of the piston) of the cylinder liner 12, an engine-rotational speed detecting means Sc for detecting a rotational speed Ne of the engine, and an engine load detecting means Sd for detecting an engine load L (a throttle opening degree or an absolute pressure within an intake pipe). The electronic control unit U controls the operation of the cooling-water flow path switch-over valve 23 mounted in the cooling-water supply passage 22 in the upper cooling circuit Ct and the operation of the cooling-water flow path switch-over valve 131 mounted in the cooling-water discharge passage 130 in the lower cooling circuit Cb.

The particular contents of the control of the temperature of the cylinder wall will be described below with reference to a flow chart in FIG. 12.

First, when the engine E is started at Step S1, a temperature Tt of the upper cylinder wall and a temperature Tb of the lower cylinder wall are detected by the upper cylinder wall temperature detecting means Sa and the lower cylinder wall temperature detecting means Sb at Step S2, respectively. Then, at Step S3*a*, the cooling-water flow path switch-over valve 131 mounted in the cooling-water discharge passage 130 in the lower cooling circuit Cb is closed and at the same time, the bypass passage 132 is closed, thereby permitting the cooling water heated by heat exchange with an exhaust gas flowing through the exhaust passage 17 to be supplied to the lower gas jacket 120 to heat the lower portion of the cylinder wall 12.

By supplying the cooling water heated by the heat of the exhaust gas to the lower gas jacket 120 simultaneously with the starting of the engine E in the above manner, the temperature Tb of the lower cylinder wall can be increased quickly to reduce the frictional force between the piston 14 and the cylinder wall 12*a*.

When the temperature Tb of the lower cylinder wall is increased up to a feedback control starting initial value Tb0 at subsequent Step S4, an engine-rotational speed Ne and an engine load L are detected at Step S5 by the engine-rotational speed detecting means Sc and the engine-load detecting means Sd, respectively, in order to start the feedback control of the temperature Tt of the upper cylinder wall and the temperature Tb of the lower cylinder wall. Thereafter, a target temperature TtOBJ for the upper cylinder wall and a target temperature TbOBJ for the lower cylinder wall are searched from the maps at Step S6 (see FIGS. 3 to 6).

If the temperature Tt of the upper cylinder wall is lower than the target temperature TtOBJ for the upper cylinder wall at subsequent Step S7, the cooling-water flow path switch-over valve 23 is opened at Step S8 to connect the bypass passage 26 to the cooling-water supply passage 22, and the cooling water passed through the upper water jacket 119 in the engine E is circulated around the radiator 21, thereby increasing the temperature Tt of the upper cylinder wall toward the target temperature TtOBJ for the upper cylinder wall. On the other hand, if the temperature Tt of the upper cylinder wall is equal to or higher than the target temperature TtOBJ for the upper cylinder wall at Step S7, the cooling-water flow path switch-over valve 23 is closed at Step S9 to disconnect the bypass passage 26 from the cooling-water supply passage 22, and the cooling water passed through the upper water jacket 119 in the engine E is supplied to the radiator 21, thereby lowering the temperature Tt of the upper cylinder wall toward the target temperature TtOBJ for the upper cylinder wall.

In this manner, the temperature Tt of the upper cylinder wall is controlled in a feedback manner so as to be converged to the target temperature TtOBJ for the upper cylinder wall. Thus, the over-heating of the engine E can be prevented to maintain the temperature of the oil film on the upper portion of the cylinder wall 12*a* (in the vicinity of the top dead center of the piston) at an appropriate point, while enhancing the durability, and the frictional force can be decreased to reduce the friction loss. Moreover, the target temperature TtOBJ for the upper cylinder wall is determined at a low engine-rotational speed and at a high engine load to provide a best combustion state, and hence, an abnormal combustion in the engine E can be prevented effectively. On the other hand, the target temperature TtOBJ for the upper cylinder wall is determined at a high engine-rotational speed and at a low engine load, so that the amount of gas blown by is smallest, and hence, the amount of gas blown by can be suppressed to the minimum.

If the temperature Tb of the lower cylinder wall is lower than the target 20 temperature TbOBJ for the lower cylinder wall at subsequent Step S10, the cooling-water flow path switch-over valve 131 in the lower cooling circuit Cb is closed at Step S11*a*, and the cooling water passed through the heat exchanger 127 to have an increased temperature is supplied to the lower water jacket 120, and the lower portion of the cylinder block 11 is heated by the heat of such cooling water, whereby the temperature Tb of the lower cylinder wall is increased toward the target temperature TbOBJ for the lower cylinder wall. On the other hand, if the temperature Tb of the lower cylinder wall is equal to or higher than the target temperature TbOBJ for the lower cylinder wall at Step S10, the cooling-water flow path switch-over valve 131 is opened, and the cooling water flowing around the heat exchanger 127 is supplied to the lower gas jacket 120, thereby cooling the lower portion of the cylinder block 11 to lower the temperature Tb of the lower cylinder wall toward the target temperature TbOBJ for the lower cylinder wall.

In this way, the cooling water heat-exchanged with the exhaust gas in the heat exchanger 127 to have the increased temperature is supplied to the lower water jacket 120 to increase the temperature Tb of the lower cylinder wall. Therefore, the temperature Tb of the lower cylinder wall can be increased quickly without use of a special heat source. In addition, the temperature Tb of the lower cylinder wall can be converged properly to the target temperature TbOBJ for the lower cylinder wall by permitting the cooling water flowing through the lower water jacket 120 to flow around the heat exchanger 127 by means of the cooling-water flow path switch-over valve 131, so that the cooling water is not passed through the heat exchanger 127.

In addition, the temperature Tb of the lower portion of the cylinder wall 12*a*(between the intermediate portion and the bottom dead center of the piston) can be brought into a temperature higher than that in the prior art to reduce the viscosity of the oil film by the feedback control of the temperature Tb of the lower cylinder wall to converge the temperature Tb to the target temperature TbOBJ for the lower cylinder wall. Thus, it is possible to reduce the frictional force between the slide portions of the piston 14 and the cylinder wall 12*a* to reduce the frictional loss, thereby providing an increase in output and a reduction in amount of fuel consumed. In addition, it is possible to reduce the oil film adhered to the cylinder wall 12*a* to reduce the amount of lubricating oil consumed.

Figure 13:
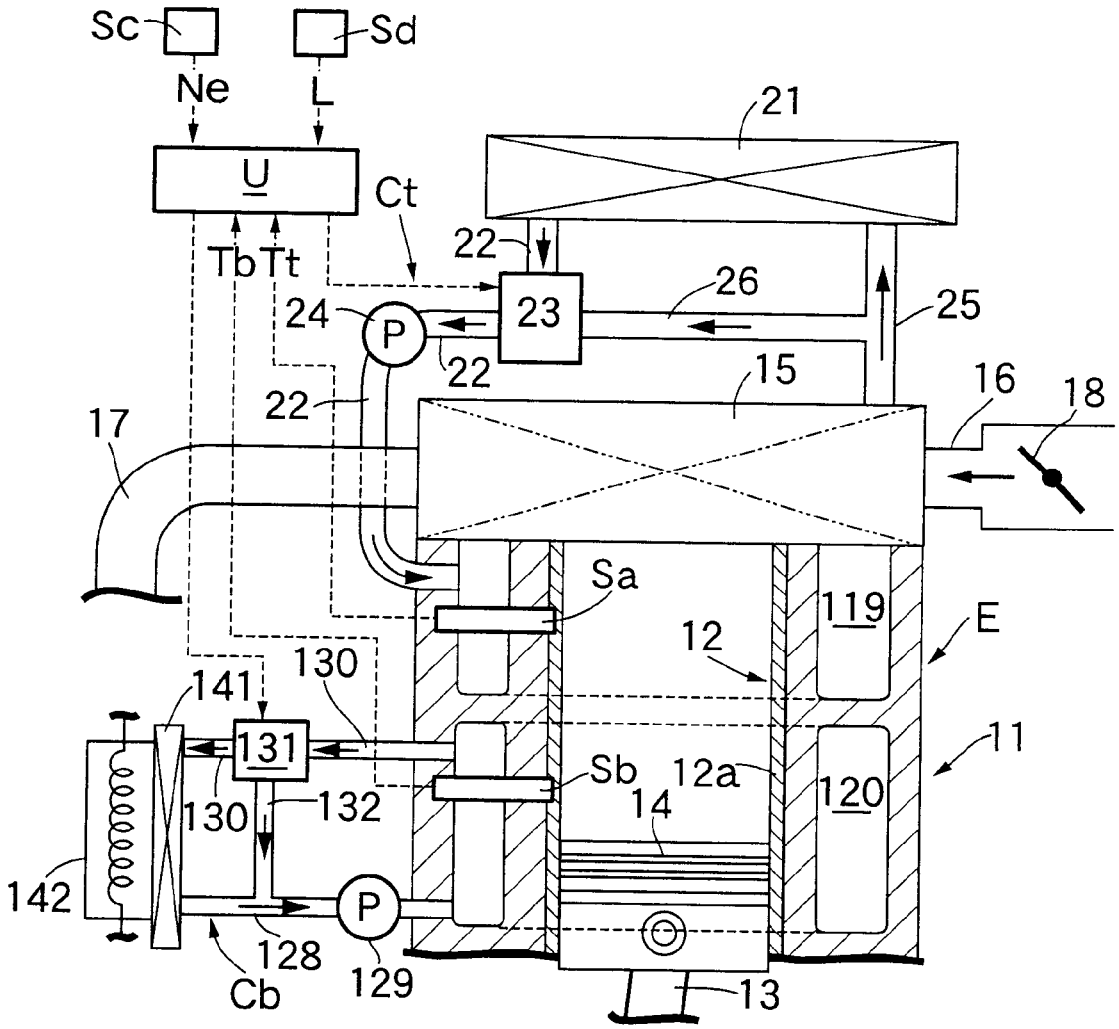
FIG. 13 is a view showing the entire arrangement of a cylinder wall temperature controlling system according to a fourth embodiment of the present invention.

A fourth embodiment of the present invention will be described with reference to FIG. 13.

In the above-described third embodiment, the heat exchanger 127 conducts the heat exchange between the exhaust gas and the cooling water, but a heat exchanger 141 in the fourth embodiment is adapted to conduct the heat exchange between an electric heater 142 and the cooling water.

Even in the fourth embodiment, a function and an effect similar to those in the third embodiment can be achieved and moreover, the cooling water can be heated by the electric heater 142 before starting of the engine E to increase the temperature Tb of the lower cylinder wall. Therefore, it is possible to effectively reduce the frictional force between the piston 14 and the cylinder wall 12*a* at the start of the engine and to contribute to an improvement in emission at the start of the engine.

A fifth embodiment of the present invention will be described below with reference to FIGS. 14 to 16.

Figure 14:
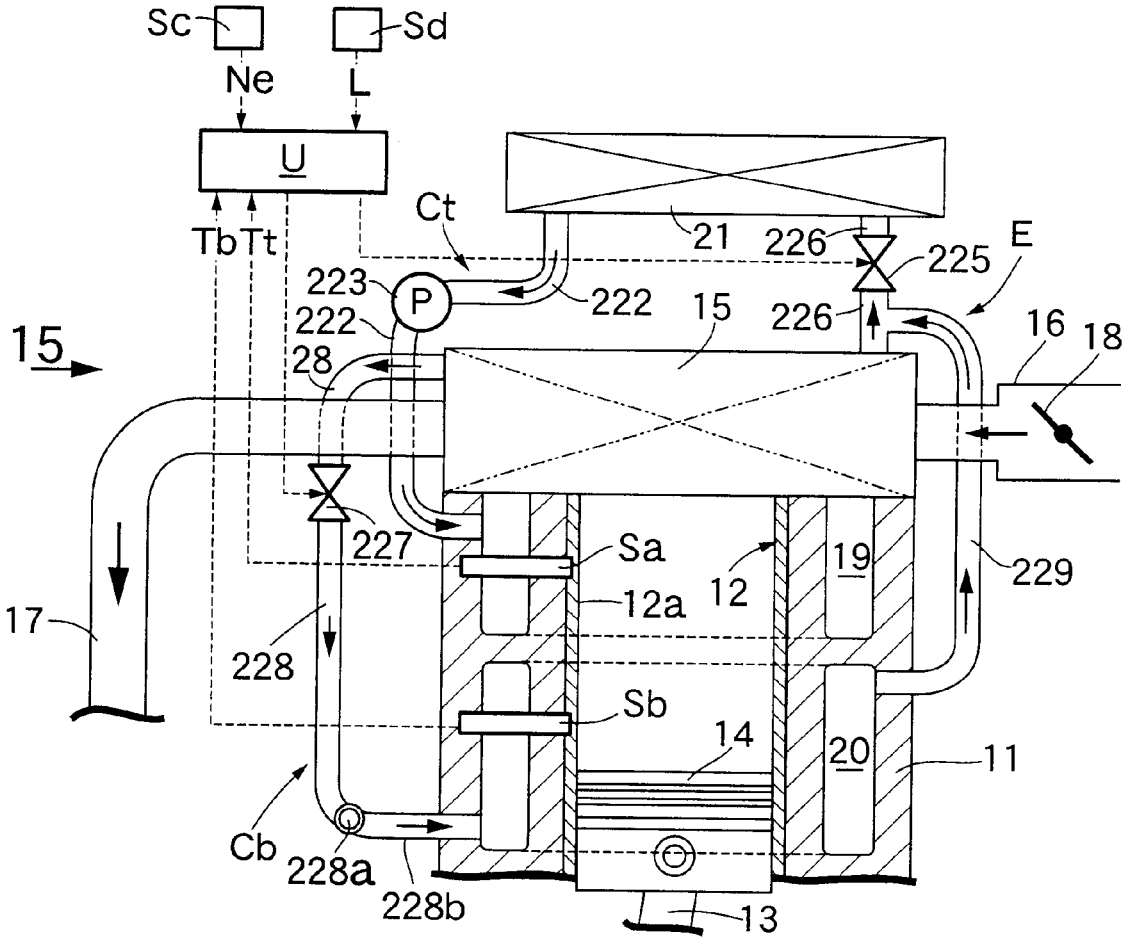
Figure 15:
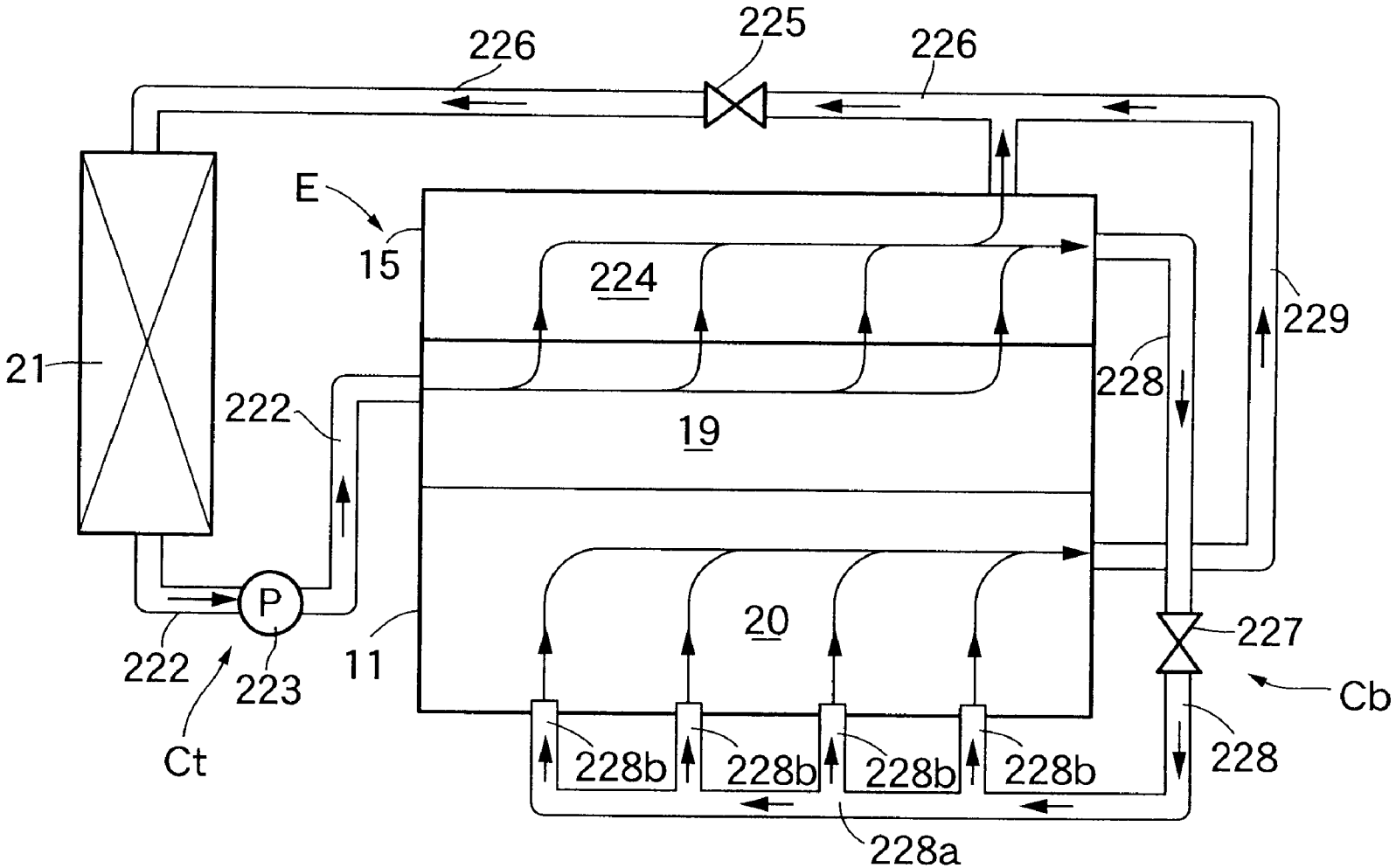
Figure 16:
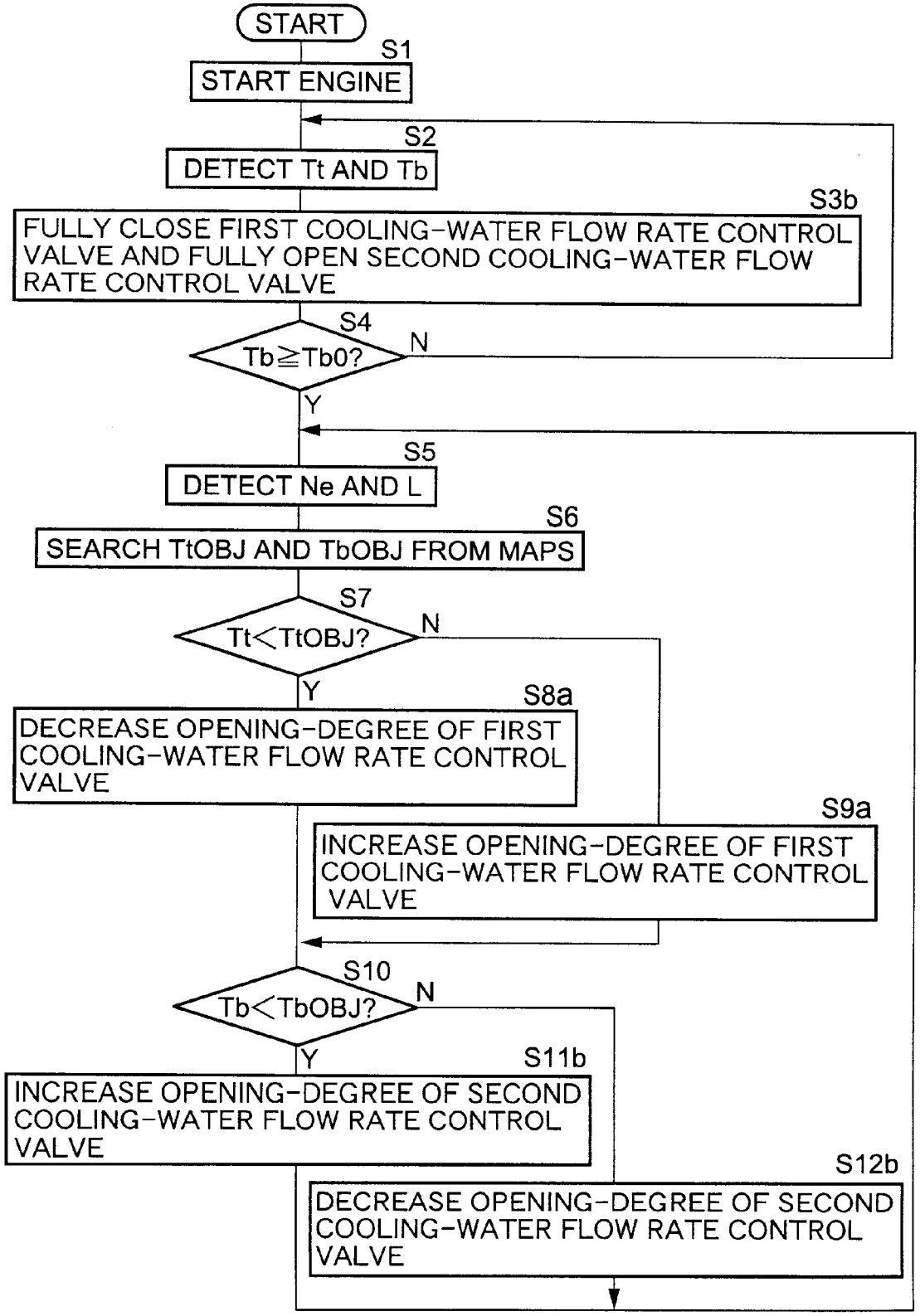

As shown in FIGS. 14 and 15, a piston 14 connected to a crankshaft (not shown) through a connecting rod 13 is slidably carried on a cylinder liner 12 fixed within a cylinder block 11 of an engine E. An intake passage 16 and an exhaust passage 17 are connected to a cylinder head 15 coupled to a top surface of the cylinder block 11, and a throttle valve 18 is mounted in the intake passage 16. An upper water jacket 19 is defined in an upper portion of the cylinder block 11, namely, at a location closer to a top dead center of the piston to surround an outer periphery of the cylinder liner 12, and a lower water jacket 20 is defined in a lower portion of the cylinder block 11, namely, at a location closer to a bottom dead center of the piston to surround the outer periphery of the cylinder liner 12.

A radiator 21 and the upper water jacket 19 in the cylinder block 11 are connected to each other by a first cooling-water supply passage 222, and a cooling-water pump 223 for pumping cooling water are mounted in the first cooling-water supply passage 222. The cooling-water pump 223 may be driven by the crankshaft of the engine E or by an electric motor. A water jacket 224 provided in the cylinder head 15 and connected to a downstream portion of the upper water jacket 19 in the cylinder block 11 is connected to the radiator 21 through a first cooling-water discharge passage 226 provided with a first cooling-water flow rate control valve 225.

A portion of the cylinder head 15 in the vicinity of an outlet of the water jacket 224 is connected to the lower water jacket 20 through a second cooling-water supply passage 228 provided with a second cooling-water flow rate control valve 227. The second cooling-water supply passage 228 includes a gallery 228*a* extending along a sidewall of the cylinder block 11. The gallery 228*a* is connected to a lower end of the lower water jacket 20 in the vicinity of four cylinder liners 12 through four branch passages 228*b*. The lower water jacket 20 is connected at its upper end to the first cooling-water discharge passage 226 at a location upstream of the first cooling-water flow rate control valve 225 through a second cooling-water discharge passage 229.

In this way, the cooling water supplied from the upper water jacket 19 to the lower water jacket 20 is dispensed to the vicinities of the four cylinder liners 12 through the gallery 228*a* and the branch passages 228*b*. Therefore, the lower cylinder wall temperatures Tb of the four cylinder liners 12 can be equalized, thereby decreasing the fluctuation in combustion and the variation in torque. Moreover, the cooling-water is passed through the branch passages 228*b* to reach the lower end of the lower water jacket 20 and hence, when the cooling water is poured into the lower water jacket 20, the withdrawal of air from the lower water jacket 20 is improved.

The upper water jacket 19, the cooling water pump 223 and the first cooling-water flow rate control valve 225 constitute an upper cooling circuit Ch, and the lower water jacket 20 and the second cooling-water flow rate control valve 227 constitute a lower cooling circuit Cb.

An electronic control unit U receives signals from an upper cylinder wall temperature detecting means Sa for detecting the temperature Tt of the upper cylinder wall at the upper portion (the location closer to the top dead center of the piston) of the cylinder liner 12, a lower cylinder wall temperature detecting means Sb for detecting the temperature Tb of a lower cylinder wall at the lower portion (the location between an intermediate portion and the bottom dead center of the piston) of the cylinder liner 12, an engine-rotational speed detecting means Sc for detecting a rotational speed Ne of the engine, and an engine load detecting means Sd for detecting an engine load L (a throttle opening degree or an absolute pressure within an intake pipe). The electronic control unit U controls the opening degree of the first cooling-water flow rate control valve 225 provided in the first cooling-water discharge passage 226 in the upper cooling circuit Ct, and the opening degree of the second cooling-water flow rate control valve 225 provided in the second cooling-water discharge passage 228 in the lower cooling circuit Cb.

The particular contents of the control of the temperature of the cylinder wall will be described below with reference to a flow chart in FIG. 16.

First, when the engine E is started at Step S1, a temperature Tt of the upper cylinder wall and a temperature Tb of the lower cylinder wall are detected by the upper cylinder wall temperature detecting means Sa and the lower cylinder wall temperature detecting means Sb at Step S2, respectively. Then, at Step S3, the first cooling-water flow rate control valve 225 provided in the first cooling-water discharge passage 226 in the upper cooling circuit Ct is closed fully and at the same time, the second cooling-water flow rate control valve 227 provided in the second cooling-water discharge passage 228 in the lower cooling circuit Cb is opened fully, whereby the cooling water passed through the upper water jacket 19 in the cylinder block 11 which is liable to receive a combustion heat and the water jacket 224 in the cylinder head 15 to have an increased temperature is supplied to the lower water jacket 20 to heat the lower portion of the cylinder wall 12*a*.

By circulating the cooling water between the upper water jacket 19 and the lower water jacket 20 simultaneously with the start of the engine E in the above manner, the temperature Tb of the lower cylinder wall can be increased quickly by the combustion heat to decrease the frictional force between the piston 14 and the cylinder wall 12*a*.

When the temperature Tb of the lower cylinder wall is increased up to a feedback control starting initial value Tb0 at subsequent Step S4, an engine-rotational speed Ne and an engine load L are detected at Step S5 by the engine-rotational speed detecting means Sc and the engine-load detecting means Sd, respectively, in order to start the feedback control of the temperature Tt of the upper cylinder wall and the temperature Tb of the lower cylinder wall. Thereafter, a target temperature TtOBJ for the upper cylinder wall and a target temperature TbOBJ for the lower cylinder wall are searched from the maps at Step S6 (see FIGS. 3 to 6).

If the temperature Tt of the upper cylinder wall is lower than the target temperature TbOBJ for the upper cylinder wall at subsequent Step S7, the opening degree of the cooling-water flow rate control valve 225 in the upper cooling circuit Ct is decreased at Step S8*a*, so that it becomes difficult for the low-temperature cooling water passed through the radiator 21 to pass through the upper water jacket 19, thereby increasing the temperature Tt of the upper cylinder wall toward the target temperature TtOBJ for the upper cylinder wall. On the other hand, if the temperature Tt of the upper cylinder wall is equal to or higher than the target temperature TtOBJ for the upper cylinder wall at Step S7, the opening degree of the first cooling-water flow rate control valve 225 is increased at Step S9*a*, so that it becomes easy for the low-temperature cooling water passed through the radiator 21 to pass through the upper water jacket 19, thereby lowering the temperature Tt of the upper cylinder wall toward the target temperature TtOBJ for the upper cylinder wall.

By the feedback control of the temperature Tt of the upper cylinder wall to converge the temperature Tt to the target temperature TtOBJ for the upper cylinder wall in the above manner, the over-heating of the engine E can be prevented to maintain the temperature of the oil film on the upper portion of the cylinder wall 12*a* (in the vicinity of the top dead center of the piston) at an appropriate point, while enhancing the durability, and the frictional force can be decreased to reduce the friction loss. Moreover, the target temperature TtOBJ for the upper cylinder wall is determined at a low engine-rotational speed and at a high engine load to provide the best combustion state, and hence, an abnormal combustion in the engine E can be prevented effectively. On the other hand, the target temperature TtOBJ for the upper cylinder wall is determined at a high engine-rotational speed and at a low engine load, so that the amount of gas blown by is the smallest, and hence, the amount of gas blown by can be suppressed to the minimum.

If the temperature Tb of the lower cylinder wall is lower than the target temperature TbOBJ for the lower cylinder wall at subsequent Step S10, the opening degree of the second cooling-water flow rate control valve 227 in the lower cooling circuit Cb is increased at Step S11*b* so that the amount of supplying of the cooling water passed through the upper water jacket 19 in the cylinder block 11 and the water jacket 224 in the cylinder head 15 and thus heated into the lower water jacket 20 is increased. Thus, the lower portion of the cylinder block 11 is heated by the heat of such cooling water, whereby the temperature Tb of the lower cylinder wall is increased toward the target temperature TbOBJ for the lower cylinder wall. On the other hand, if the temperature Tb of the lower cylinder wall is equal to or higher than the target temperature TbOBJ for the lower cylinder wall at Step S10, the opening degree of the second cooling-water flow rate control valve 227 is decreased, so that the amount of high-temperature cooling water supplied into the lower water jacket 20 is decreased, thereby cooling the lower portion of the cylinder block 11 to lower the temperature Tb of the lower cylinder wall toward the target temperature TbOBJ for the lower cylinder wall.

In this way, the cooling water passed through the upper water jacket 19 in the cylinder block 11 and the water jacket 224 in the cylinder head 15 and thus heated is supplied to the lower water jacket 20 to increase the temperature Tb of the lower cylinder wall. Therefore, the temperature Tb of the lower cylinder wall can be increased quickly without use of a special heat source. In addition, the temperature Tb of the lower cylinder wall can be converged properly to the target temperature TbOBJ for the lower cylinder wall by controlling the flow rate of the cooling water flowing through the lower water jacket 20 by the second cooling-water flow rate control valve 227.

In addition, the temperature Tb of the lower cylinder wall 12*a* (between the intermediate portion and the bottom dead center of the piston) can be brought into a temperature higher than that in the prior art to reduce the viscosity of the oil film by the feedback control of the temperature Tb of the lower cylinder wall to converge the temperature Tb to the target temperature TbOBJ for the lower cylinder wall. Thus, it is possible to reduce the frictional force between the slide portions of the piston 14 and the cylinder wall 12*a* to reduce the frictional loss, thereby providing an increase in output and a reduction in amount of fuel consumed. In addition, it is possible to reduce the oil film adhered to the cylinder wall 12*a* to reduce the amount of lubricating oil consumed.

While specific embodiments have been described, variations of those embodiments are also possible. For example, the engine E in each of the embodiments includes the cylinder liner 12, but the present invention is also applicable to an engine E having no cylinder liner 12.

In the first embodiment, the exhaust gas and the fresh air are supplied to the common gas jacket 20, but a gas jacket for the exhaust gas and a gas jacket for the fresh air may be provided separately.

The water jacket 42 of the cooling means Mc is provided in the heat transfer member 41 in the second embodiment, but may be provided in the cylinder block 11.

Although the embodiment of the present invention has been described in detail, it will be understood that the present invention is not limited to the above-described embodiments, and various modifications in design may be made without departing from the spirit and scope of the invention defined in claims.

What is claimed is:

1. A system for controlling a temperature of a cylinder wall in an engine, comprising:

heating means for heating at least a portion of a cylinder wall in a vicinity of a bottom dead center of a piston which is slidably guided in the cylinder wall;

cooling means for cooling at least said portion of said cylinder wall in the vicinity of the bottom dead center of the piston;

temperature detecting means for detecting a temperature of the cylinder wall; and control means for controlling said heating means and said cooling means, based on the detected temperature of the cylinder wall, so that said detected temperature of the cylinder wall is brought into a target temperature.

2. A system for controlling a temperature of a cylinder wall in an engine according to claim 1, wherein said heating means heats the cylinder wall by an exhaust gas flowing through a gas jacket defined in a cylinder block, and said cooling means cools the cylinder wall by fresh air flowing through the gas jacket defined in the cylinder block.

3. A system for controlling a temperature of a cylinder wall in an engine according to claim 1, wherein said heating means comprises a heat transfer member for transferring heat of an exhaust gas to a cylinder block, and said cooling means cools said heat transfer member by cooling water flowing through a water jacket defined in said heat transfer member.

4. A system for controlling a temperature of a cylinder wall in an engine, comprising:

an upper water jacket facing a portion of a cylinder wall on which a piston is slidably guided, where said upper water jacket is adjacent to a top dead center of the piston;

a lower water jacket facing another portion of said cylinder wall, which is adjacent to a bottom dead center of the piston;

an upper cylinder portion temperature detecting means for detecting a temperature of an upper portion of said cylinder wall adjacent to the top dead center of the piston;

a lower cylinder portion temperature detecting means for detecting a temperature of a lower portion of the cylinder wall adjacent to the bottom dead center of the piston;

an upper cooling circuit for controlling cooling water flowing through said upper water jacket to converge the temperature of the upper portion of the cylinder wall detected by said upper cylinder wall temperature detecting means to a target temperature for the upper portion of the cylinder wall; and a lower cooling circuit for controlling the cooling water flowing through said lower water jacket to converge the temperature of the lower portion of the cylinder wall detected by said lower cylinder wall temperature detecting means to a target temperature for the lower portion of the cylinder wall.

5. A system for controlling a temperature of a cylinder wall in an engine according to claim 4, wherein said lower cooling circuit includes a heat exchanger for heating the cooling water flowing through said lower water jacket by the heat of an exhaust gas.

6. A system for controlling a temperature of a cylinder wall in an engine according to claim 4, wherein said lower cooling circuit includes a heat exchanger for heating the cooling water flowing through said lower water jacket by the heat of an electric heater.

7. A system for controlling a temperature of a cylinder wall of each of a plurality of cylinders in a multi-cylinder engine, comprising:

an upper water jacket facing a portion of a cylinder wall on which a piston is slidably guided, where said upper water jacket is adjacent to a top dead center of the piston; and a lower water jacket facing another portion of said cylinder wall adjacent to a bottom dead center of the piston;

wherein cooling water exiting the a radiator is passed through said upper water jacket and then through said lower water jacket back to said radiator, and wherein the cooling water passing through said upper water jacket is supplied to a lower end of said lower water jacket through respective branch passages of a gallery which correspond to said plurality of cylinders.

* * * * *